US007588225B2

(12) United States Patent
Wawerski

(10) Patent No.: US 7,588,225 B2
(45) Date of Patent: Sep. 15, 2009

(54) PORTABLE DEVICES FOR DETACHABLY SECURING CANS AND OTHER OBJECTS

(76) Inventor: Marvin Wawerski, 3213 N. State Route 71, Ottawa, IL (US) 61350-9410

( * ) Notice: Subject to any disclaimer, the term of this patent is extended or adjusted under 35 U.S.C. 154(b) by 534 days.

(21) Appl. No.: 11/430,465

(22) Filed: May 9, 2006

(65) Prior Publication Data

US 2006/0255233 A1 Nov. 16, 2006
US 2007/0057142 A9 Mar. 15, 2007

Related U.S. Application Data

(60) Provisional application No. 60/680,717, filed on May 13, 2005.

(51) Int. Cl.
*A47K 1/08* (2006.01)

(52) U.S. Cl. ..... 248/311.2; 248/689; 248/690; 248/309.1; 248/310; 248/311.3; 248/312; 248/312.1; 248/316.6; 248/210; 248/211; 248/316.8; 220/768; 294/169; 294/154; 294/137; 294/143; 294/162; 294/170; 224/666; 224/242; 224/269; 224/270; 16/425

(58) Field of Classification Search ..... 248/689, 248/690, 309.1, 310, 311.2, 311.3, 312, 312.1, 248/316.6, 210, 211, 316.8; 220/768; 294/169, 294/154, 137, 143, 159, 162, 170; 224/666, 224/242, 269, 270; 16/425
See application file for complete search history.

(56) References Cited

U.S. PATENT DOCUMENTS 313,667 A * 3/1885 Hesser ..... 248/318
451,171 A * 4/1891 Reilley ..... 220/640
1,005,235 A * 10/1911 Langguth ..... 294/87.2
1,256,583 A * 2/1918 Meatyard ..... 248/312
1,858,144 A 5/1932 Fariello
1,858,656 A 5/1932 Batherman
2,092,456 A * 9/1937 Hunker ..... 294/159
2,362,331 A * 11/1944 Weber ..... 294/159
2,398,948 A * 4/1946 Martinez ..... 294/87.22
2,540,818 A * 2/1951 Gilhooly ..... 248/312
2,795,454 A * 6/1957 Snook ..... 294/31.2
2,912,205 A 11/1959 Toune
3,227,411 A 1/1966 Treutler
3,980,264 A 9/1976 Tomasik
3,998,416 A 12/1976 Benolkin
4,011,951 A * 3/1977 Boyer ..... 211/85.21
4,097,012 A * 6/1978 McIntyre ..... 248/674

(Continued)

*Primary Examiner*—J. Allen Shriver, II
*Assistant Examiner*—Nkeisha J Smith

(57) ABSTRACT

Devices and methods are provided for detachably securing cans for use in plumbing, painting, construction, and home improvement. The devices are configured for mounting a structure such as a ladder, scaffold, bench, tool box, saw horse, table, railing, pipe, wood, lumber, metal, or plastic support or other object and further configured for detachably securing cans, such as cans containing PVC glue or primer for a plumber's use. In one device, the securing members have two arms configured to be arranged in an open state for receiving the can with substantially zero insertion force. In that device, the arms have end portions with latching members configured to join together in a first engagement position with the can. In a closed state, the latching members are in a partially overlapping configuration that pulls the arms tightly around the circumference of the can and thereby supplies a compression fit with high pull-apart strength.

17 Claims, 12 Drawing Sheets

U.S. PATENT DOCUMENTS 4,294,481 A * 10/1981 Pearl ..... 294/146
4,613,042 A 9/1986 Aeschliman
4,643,342 A * 2/1987 Borelli, III ..... 224/541
4,660,870 A * 4/1987 Donley ..... 285/419
4,702,446 A 10/1987 Brown
4,790,462 A * 12/1988 Kawaguchi ..... 224/250
4,867,359 A * 9/1989 Donovan ..... 224/602
5,249,770 A * 10/1993 Louthan ..... 248/311.2
5,396,885 A * 3/1995 Nelson ..... 128/204.18
5,584,453 A 12/1996 Morter
5,695,232 A * 12/1997 Tipp ..... 294/87.2
5,711,433 A * 1/1998 Smith ..... 211/71.01
5,755,474 A * 5/1998 Slomski ..... 294/87.2
5,813,579 A * 9/1998 Hendrickson ..... 224/42.11
5,906,302 A * 5/1999 Spergel ..... 224/250
5,913,467 A * 6/1999 Berg ..... 224/628
5,947,351 A * 9/1999 Garofalo et al. ..... 224/153
5,992,624 A 11/1999 Hodson
6,032,808 A * 3/2000 Henson ..... 211/85.23
6,045,017 A * 4/2000 Connell ..... 224/148.7
6,076,874 A * 6/2000 Lovette ..... 294/87.2
6,311,946 B1 * 11/2001 Hoffman ..... 248/682
6,352,135 B1 3/2002 Jones
6,412,741 B1 * 7/2002 Olivero ..... 248/313
6,557,738 B1 * 5/2003 Meintzer ..... 224/148.7
6,766,912 B1 * 7/2004 Gibbs ..... 211/74
6,802,484 B1 * 10/2004 Kiley et al. ..... 248/311.2
7,267,254 B2 * 9/2007 Perez ..... 224/666
7,387,224 B1 * 6/2008 Backus ..... 224/42.11
2004/0089688 A1 5/2004 Perez

* cited by examiner

PORTABLE DEVICES FOR DETACHABLY SECURING CANS AND OTHER OBJECTS

RELATED APPLICATIONS

The present patent document claims the benefit of the filing date under 35 U.S.C. §119(e) of Provisional U.S. Patent Application Ser. No. 60/680,717, filed May 13, 2005, which is hereby incorporated by reference in its entirety.

FIELD OF THE INVENTION

The present invention relates to carrying devices for use in fields including plumbing, painting, construction, and home improvement in general. More particularly, this invention provides devices configured to be mounted onto a desired object, such as a ladder rung, and using securing members for detachably securing cans and other objects, such as cans containing polyvinyl chloride ("PVC") glue or primer.

BACKGROUND OF THE INVENTION

Carrying and balancing two or more cans while working in plumbing, painting, construction, or simply around the house, yard, or garage sometimes present a real chore and at other times lead to accidents, spilling, or dropping the cans or their contents. These concerns also give rise to inefficient downtime, costly extra helpers, and increased aggravation for the user.

Addressing plumbers as just one illustrative and non-limiting example, plumbers for years have been carrying one can containing glue and a second can containing primer for joining pipes, such as pipes made of PVC. For instance, plumbers often bond two PVC pipes together by cleaning with primer the areas on the respective pipes to be bonded. After priming the areas, the plumber applies PVC glue to the areas and then brings those areas together in a coupling engagement. Once the glue dries, the pipes are bonded.

Quite often, the plumber's work carries over to many other locations at the job site or even to different job sites, thereby necessitating the plumber to transport the cans. A common practice among plumbers includes using duct tape or electrical tape to join the cans together and then carrying them as a single unit to the next location. While such a practice might help in rare instances when the cans are depleted at the same time, in the more typical case one can is depleted first. As a result, the plumber must carry scissors or a knife and cut the used can free from the tape only to tape a new can to the partially used can. The original partially used can will invariably deplete before the new can, however, thereby requiring the plumber to repeat these cumbersome taping and un-taping steps with yet another new can, and so on.

Others have attempted to resolve these problems previously. As one example, United States Published Patent Application No. 2004/0089688A1 ("the '688 application") shows clasps having an aperture of predetermined dimension for introducing containers. The apertures, which are C-shaped for inserting containers, measure from approximately 2 to 4 inches in width. In order to insert the containers through the side aperture in the '688 application, the clasps must allow flexing. To be flexible, however, decreases the pull-out strength between the pair of clasps. In other words, the flexibility property between the clasps competes with the holding property of the clasps. As otherwise stated, increasing the clasp strength may increase the holding property but results in decreased flexibility and, therefore, increased difficulty in spreading the clasps apart for inserting the containers. In addition, a clasp having increased rigidity may, during insertion through the aperture, sustain plastic deformation, damage the container, or risk injuring the user.

Like the clasps with apertures as shown in the '688 application, U.S. Pat. No. 5,992,624 ("the '624 patent") illustrates clips having apertures for spreading apart and thereby receiving a can. One embodiment shows the need for upper and lower clips for each can, while another embodiment shows the lower clip being replaced with pans having a flat base for the cans to rest on. These clips give rise to the problems already described in connection with the clasps in the '688 application.

The devices for detachably securing cans and other objects solves these and other problems by providing securing members having holding arms according to the present invention.

Turning to another problem with the devices illustrated in the '624 patent and the '688 application, the '624 patent, for instance, fails to teach any feature for securing the horizontal position of the cans. On the contrary, the '624 patent shows a fastener for attaching to an overhead structure like a ceiling joist, and the fastener extends vertically upward from an arm designed for allowing the device to rotate and tilt. This very rotating and tilting, however, contribute to the problems with accidents, spilling, or dropping the cans resolved with the present invention. Furthermore, overhead suspended devices present safety concerns to the user and other workers at a work site. In addition, one fastener bears the entire weight of both cans. The '688 application shows a device having an opening between an arm on one side and a folded-down tongue and hook on the other side for sliding designed to be worn about a user's belt or simply hanging from a structure. As a consequence, the cans move with all of the degrees of freedom of the person who is wearing the device on the waist. Furthermore, because the vertical arm in the '688 application is offset to one side relative to the adjacent clasps, the weight of the cans is not evenly distributed when the device hangs from a structure, and the device thereby becomes unstable.

The devices for detachably securing cans and other objects solves these and other problems by providing a brace body having a bracket according to the present invention.

SUMMARY OF THE INVENTION

Devices for use with detachably securing cans are provided. In one embodiment, the device includes a brace body comprising a bracket. The bracket has a support member and lateral restraints protruding down from the support member and spaced apart to form a brace body channel below the support member and between the lateral restraints, the brace body channel being sized and configured to detachably mount onto an object. Securing members are attached to the brace body and extend laterally from the brace body and are spaced apart by the brace body channel. The securing members have a pair of arms configured for detachably securing said can.

In an alternative embodiment, the device includes a brace body configured for mounting to an object. Securing members attach to, and extend laterally from, the brace body. The securing members have arms that receive a can with substantially zero insertion force. The arms have latch members configured to detachably join in a partially overlapping arrangement and provide a circumferentially closed engagement about the can with a compression fit having a high pull-apart strength.

In another embodiment of a device for detachably securing cans, the device has a handle secured to a support body. The support body includes an attachment joint for joining a securing member to the support body. The securing members extend laterally from the support body, and have arms that receive a can with substantially zero insertion force. The arms have latch members configured to detachably join in a partially overlapping arrangement and provide a circumferentially closed engagement about the can with a compression fit having a high pull-apart strength.

Methods of detachably securing cans are also provided. In one embodiment, a method according to the invention includes providing a device comprising a body having a post receiving channel configured to mount onto a post, and having securing members attached to the body by an attachment joint, the securing member having arms configured to hold a can. A can is disposed between the arms of the securing member. The latch members are brought together such that the arms are in a first engagement position about the can. The latch members are closed in a partially overlapping configuration to move the arms into a second compressed engagement position about the can circumference for holding the can. The device is mounted onto a post partially received in the post receiving channel.

BRIEF DESCRIPTION OF THE DRAWINGS

Embodiments of the present invention will now be described by way of example only, and not by way of limitation, with reference to the accompanying drawings briefly described as follows.

DETAILED DESCRIPTION OF THE PREFERRED EMBODIMENTS

Although not limited in its scope or applicability, the present invention relates generally to carrying devices. More particularly, and by way of illustration and not by way of limitation, the present invention relates to carrying devices for use in fields including plumbing, painting, construction, and home improvement in general, and methods of using those devices.

For the purpose of promoting an understanding of the principles of the invention, the following provides a detailed description of embodiments of the invention as illustrated by the drawings as well as the language used herein to describe various aspects of the invention. The description is not intended to limit the invention in any manner, but rather serves to enable those skilled in the art to make and use the invention. As used herein, the terms comprise(s), include(s), having, has, with, contain(s) and variants thereof are intended to be open ended transitional phrases, terms, or words that do not preclude the possibility of additional steps or structure.

Figure 1:
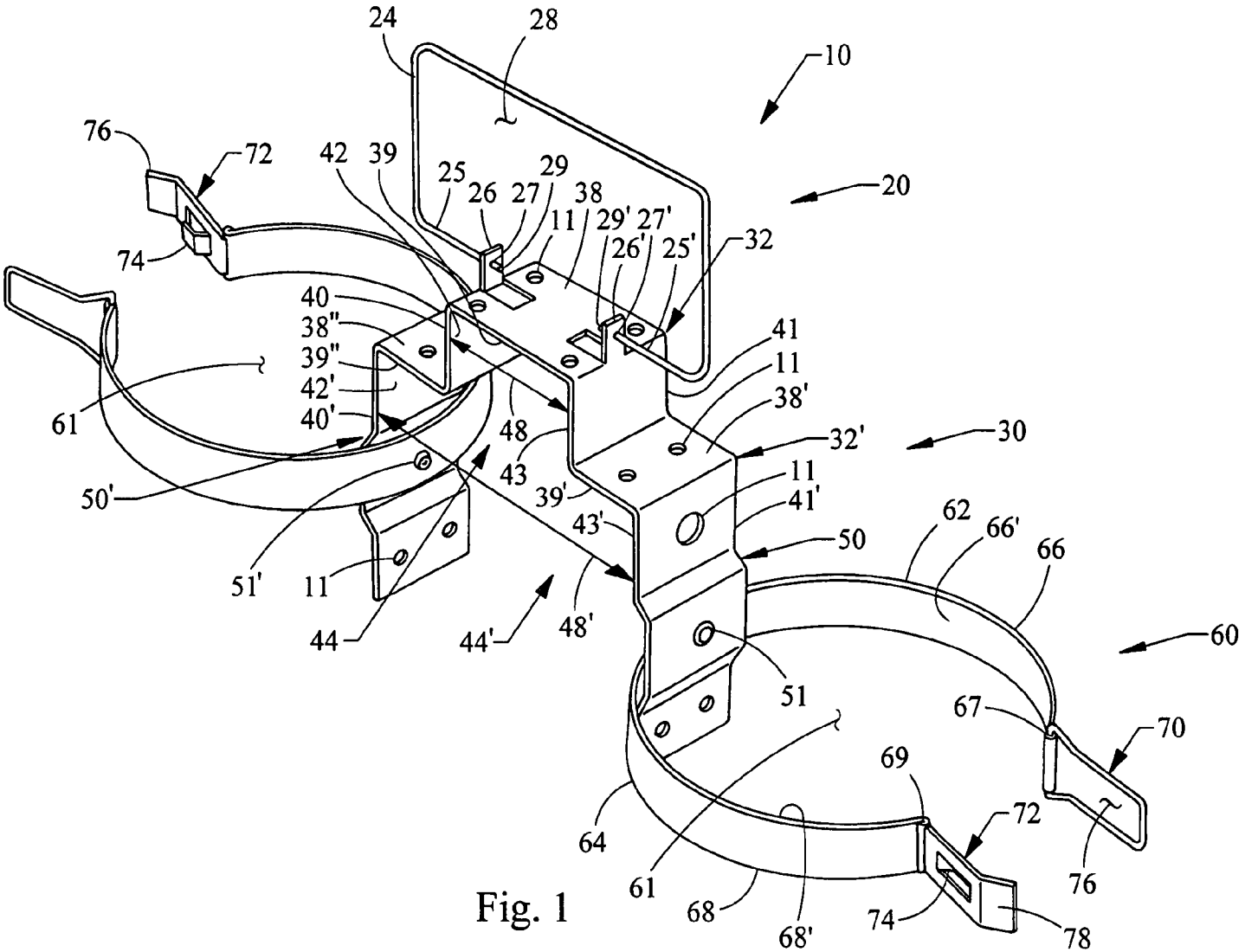
FIG. 1 provides a perspective view of a device for detachably securing cans and other objects according to one embodiment of the invention.

FIG. 1 shows a device 10 according to one embodiment of the invention. A device 10 comprises an optional handle portion 20, a brace body 30, and at least two securing members 60 configured for detachably securing cans, containers, bottles, receptacles, containers, and other objects ("cans"). As one of ordinary skill in the art should understand, cans come in many shapes (from cylindrical to triangular to rectangular and any combination in between), sizes (e.g., cup, pint, quart, liter, gallon, and any receptacle greater or lesser than these), uses (e.g., paint, cleaner, glue, cement, primer, or any materials for plumbing, painting, construction, and home improvement, just to name a few), and material (natural, synthetic, plastic, metal, or combination thereof). The device 10 may be used with any type of can, having any of these shapes, sizes, or uses, and made of any of these materials.

A handle 20 may be any straight, bent, curved, looped, bar, wire, or other structure that is gripped to move or use the device 10. Three typical characteristics for a handle 20 according to the present invention include strength, length, and gripping. First, the handle should provide sufficient strength to support the device with and without the weights of the cans, or otherwise to transmit the force involved in the task the handle serves. Second, the handle should have a length sufficient to permit the hand or hands gripping it to reliably exert that force. Third, the handle should have a sufficiently sized circumference to permit the hand or hands to surround it to grip it as solidly as needed to exert that force. Other characteristics may apply to handles. For instance, a sheath or coating on the handle could provide friction against the hand, thereby reducing the gripping force needed to achieve a reliable grip. In one embodiment, a handle comes with a sufficient diameter that permits comfortable and ergonomic carrying, with otherwise bare hands, of a heavy package, because an inadequately sized diameter exerts pressure on the fingers that grasp it directly, which would often be unacceptable at least for certain weights over extenuated lengths of time. Furthermore, handles may be retractable, immovably fixed, or capable of articulating relative to another object, such as the brace body 30.

The present handle 20 has—but does not require—these characteristics, although a handle 20 according to the invention may be any structure that is gripped to move or use the device 10. The handle 20 and its components may be made of any suitable material (natural, synthetic, plastic, rubber, metal, or combination thereof) that is flexible, such as nylon, or rigid, such as some metals or plastics. The handle 20 according to the present invention shall be construed to have its plain and ordinary meaning, rather than any lexicographic definition. One non-limiting and illustrative embodiment, however, will now be described.

As shown in FIG. 1, the handle 20 in one embodiment a holding body 24. In one embodiment, the holding body 24 is an adequately sized wire according to one or more characteristics that apply to handles discussed above. The holding body 24 in this embodiment has optional ends 25, 25', respectively, although the holding body 24 may have only one end, or no ends as in the case of a looping handle. The ends 25, 25' rotatably secure to tabs 26, 26', respectively, formed integral with the brace body 30 or mounted onto the brace body 30 by any suitable means, such as welding, soldering, brazing, adhesives, or resins, as a few non-limiting examples. The holding body ends 25, 25' insert through tab receptors 27, 27', respectively. Once inserted into the receptors, the ends 29, 29' may be secured to prevent pullout by any suitable means, including but not limited to mechanical techniques such as crimping, swaging, nuts and bolts. The holding body ends, as secured, form a circumference with passageway 28 sufficiently sized for receiving a user's fingers.

The handle 20 is optional. That is, the handle 20 may be omitted or removed completely. As but one example, the end user may carry the device at the brace body 30. When not holding a can, either pair of securing members 60 presents a structure for transporting the device. Indeed, while helpful for carrying cans from one location to the next, the end user may opt to affix the device as a semi-permanent accessory to another structure. As just a few examples, the end user could attach the device permanently or semi-permanently to a ladder, bench (e.g., work bench), tool box, saw horse, table, railing, pipe, scaffold, or to any support structure comprising a piece of wood, lumber, metal, or plastic support or other object (for shorthand, "post" shall refer to any object on which a user may mount the device). FIG. 1 shows optional cavities 11 extending through the brace body 30 and sized for receiving removable fasteners (not shown) selected from any one or combination of a threaded, unthreaded, or partially threaded screw, bolt, nail, rivet, pin, staple, hook, and stud. The fasteners may be used temporarily in order to provide additional support to the device 10 and then removed so that the portable device 10 could be transported away.

Turning to a brace body 30 of FIG. 1 according to one embodiment of the invention, a brace body 30 that comprises a first bracket 32 and optional second bracket 32', each bracket being sized for receiving a post to which the device may mount, and further comprises optional attachment joints 51, 51' for attaching the brace to a securing member 60. The brace body 30 and its components may be made of any suitable material comprising natural, synthetic, metal, or combination thereof, including for instance steel, aluminum, titanium, or other metal alloy or plastic. Furthermore, the brace body 30 may be formed in any shape desired for the intended post.

A first bracket 32 according to the present invention shall be construed to have its plain and ordinary meaning, rather than any lexicographic definition. In one non-limiting and illustrative embodiment, the first bracket 32 may be any inverted "L," inverted "Y," inverted "J," inverted "U," inverted "V," inverted and flattened "U," "T," inverted and open ended square or rectangle, or other suitable rounded, curved, rectangular, or saddle shaped structure configured for mounting onto a post. The first bracket 32 comprises a support member 38 having an inner surface 39 for optionally engaging (e.g., abutting, contacting) a top portion of a post or otherwise disposed above a top portion of a post. In addition, at least two lateral restraints 40, 41 protrude downward from the support member 38, the restraints 40, 41 being spaced apart a distance 48 to form a first brace body channel 44 sized for mounting to a post and wherein the lateral restraints have inner surfaces 42, 43 for optionally engaging the post. In addition to the first bracket 32, one embodiment according to the invention comprises a second bracket 32' having a pair of support members 38', 38" with inner surfaces 39', 39" and having a lateral restraint 40', 41', respectively, extending downward therefrom, the lateral restraints 40', 41' being spaced apart 48' to form a second brace body channel 44' and having inner surfaces 42', 43', the second brace body channel 44' sized for mounting a post. Optionally, the first bracket 32 and the second bracket 32' may comprise a stair-stepped configuration when viewed end-on. Otherwise stated, the first horizontal support member 38 and the first lateral restraint 40, 41 comprise a first step, and the second horizontal support member 38', 38" and the second lateral restraint 40', 41', such that the first and second brackets 32, 32', respectively, comprise a stair-stepped configuration.

The two lateral restraints 40, 41 of the first bracket 32, as well as the two lateral restraint 40', 41' of the second bracket 32', may be spaced apart any suitable distance for detachably mounting (e.g., straddling) a post. In one embodiment, the first bracket lateral restraints 40, 41 are separated by approximately 1½ inches for detachably mounting to a 2×4, 2×6, 2×8, and the like, where one of ordinary skill in the art will understand that those first measurements are actually about 1½ inches. In one embodiment, the second bracket lateral restraints 40', 41' are separated approximately 3½ inches for detachably mounting to a ladder rung, or any appropriate distance for mounting to a ladder rung. The invention is not limited to these distances, which may be greater or lesser as desired and for a particular purpose or post for which the device 10 is intended.

Nor is the invention limited to lateral restraints or support members of a particular length, width, or thickness. In one embodiment, the lateral restraints 40, 41 may be approximately 1¾ inches in length and protrude down from the securing member 38 a height of approximately ¾ inches, while the lateral restraints 40', 41' measure about 1¾ inches in length and protrude down from the securing members 38', 38" a height of approximately 1 inch. However, the lateral restraints 40, 41, 40', 41' could be longer or shorter than these lengths and heights, as desired and for a particular purpose or post for which the device 10 is intended. Furthermore, the securing members 38, 38', 38"may be any of the curved, rectangular, and other shapes and designs as previously described. In one embodiment for an approximately rectangular securing member 38, the width and length may be in the range from about 1½ inch to about 1¾ inch, while the securing members 38', 38" may have measurements that may be about 1½ inches to about 1¾ inches in length and about ¾ inch to about 1 inches in width. However, the securing members 38, 38', 38" could be longer or shorter than these lengths and heights, as desired and for a particular purpose or post for which the device 10 is intended.

The brace body 30 further may comprise two optional legs 50, 50'. The legs may be any desired height and length, and in one non-limiting embodiment measure approximately 2 inches in hand from about 1½ inches to about 1¾ inches in length, although they may be longer or shorter than these lengths and heights, as desired and for a particular purpose or post for which the device 10 is intended. Attachment joints 51, 51' attach the legs 50, 50', respectively to securing members 60. Attachment may be by any suitable securing mechanism such as a nut, bolt, screw, brace, thread, cotter and pin, clip, crimp, swage, thread, full or partial bearing, rivet, pin, fastener, or interlocking members, or securing material such as a glue, adhesive, resin, welding, soldering, brazing, heat bonding, chemical bonding material or combinations thereof and the like. In addition, the joints 51, 51' may be formed integral with the legs 50, 50' and/or the lateral restraints. These legs are optional, because the foregoing lateral restraints may serve the same function and thereby replace the legs. Therefore, it shall be understood that the following description of joints for joining the securing members to the brace body 30 also describes the lateral restraints.

FIG. 1 also shows that the device further comprises a securing member 60 configured for detachably securing cans. The securing member 60 may be any material (natural, synthetic, plastic, rubber, metal, or combination thereof). According to one embodiment of the invention, the securing member 60 is any suitable band clamp, and the term band clamp shall have its plain and ordinary meaning rather than any lexicographic definition. In a preferred embodiment, the device comprises two securing members 60 substantially diametrically opposed to each other, or approximately 180 degrees apart.

The securing members 60 have two moveable arms 62, 64 extending laterally from the brace body 30 and adapted for detachably engaging a can. In one embodiment, the arms 62, 64 each comprises a latch end portion 66, 68 having a can-contacting surface 66', 68' configured for detachably engaging said can. In one embodiment, the latch end portions 66, 68 comprise rotatable securing latch members 70, 72, wherein the latch members 70, 72 may be rotatably secured to the latch end portions 66, 68 by any suitable means, such as link members 67, 69. For example, the link members 67, 69 may be disposed against the latch end portions 66, 68 within a slot or other opening formed in the latch, and then the latch end portions 66, 68 bent back upon themselves, respectively, to form an opening with an inner diameter great enough to allow the latches to rotate. Alternatively, the link members 67, 69 may be swivel pins, whereby the latch end portions 66, 68 of the arms 62, 64 each has an opening that receives a swivel pin attached to the latch. As another option, the link members 67, 69 may be an opening in the latch end portions 66, 68 of the arms 62, 64 and a latch having a notch or cutout with two opposing protrusions that extend into the opening to allow the latch to rotate relative to the arms. Still another example of link members 67, 69 may be a spring loaded swivel pin in the opening disposed at the latch end portions 66, 68 of the arms 62, 64, with the spring loaded swivel pin having ends that rotatably secure to receptors in the latches.

The securing members 60 further comprise a substantially zero insertion force can receiving socket 61 (hereafter "ZIF socket 61). In describing embodiments of the invention, the ZIF socket is any partly enclosed or bounded opening, recess, aperture, cavity, hollow, or receptacle formed between the arms 62, 64 such that, when the arms 62, 64 are in an open state, the arms 62, 64 and/or the ZIF socket 61 may receive a can with substantially zero insertion force from the top of the securing member 60, from the bottom of the securing member 60, or from the side of the securing member 60 (e.g., between the latch end portions 66, 68 of the arms 62, 64). In one embodiment, the arms 62, 64 may be made of stainless steel such that the arms 62, 64 (when not latched together) may spread apart. The moveable arms 62, 64 may be spread apart manually, or they may be made such that they are spring biased to move into an outward transverse direction and thereby spread apart, for easy insertion of a can within the ZIF socket 61.

FIG. 1 also shows an embodiment of the latch member 72 comprising a clasp 74 configured to insert into a receiving compartment 76 of latch member 70. According to this configuration, the latch member 70, 72 of each arm 62, 64, respectively, joins with the latch member of the opposing clamp arm in a first engagement position about the can. After inserting the clasp 74 of the arm 64 into the receiving compartment 76 of the latch member 70 of the arm 62, the latch member 72 is swung away from the latch member 70 such that the latch member 72 moves the clasp 74 (and therefore pulls the latch member 70) into a closed position and thereby tightens the hold on the can. According to this configuration, the latch member 70, 72 of each arm 62, 64, respectively overlaps approximately the distance between the link member 69 and the clasp 74, which moves the arms into a second compressed engagement position about the can. This second position results in a closed state for supplying a compression fit with high pull-apart strength. Because the tab 78 on the latch member 72 is offset, it helps to provide a gripping surface for unlatching the latch members and reopening the securing arms in order to quickly and easily release the cans.

Before turning to the other figures, it should be noted that like elements from FIG. 1 are labeled the same. Embodiments and descriptions of those like elements as discussed above are incorporated by reference in the remaining figures.

Figure 2:
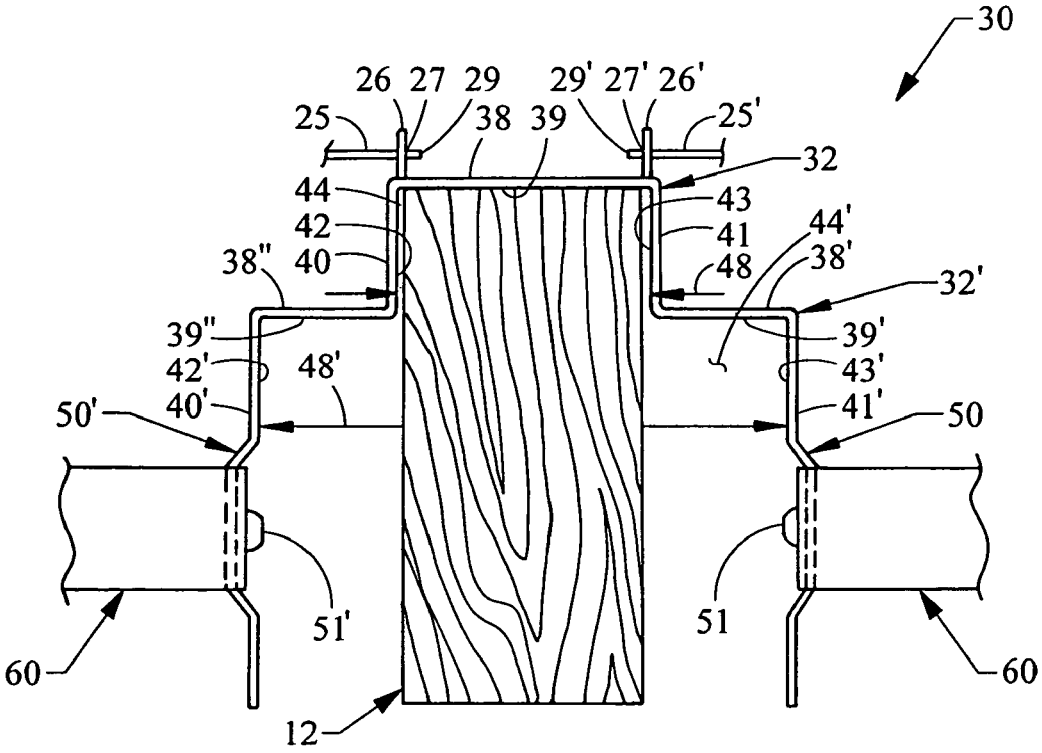
FIG. 2 provides an end-on view of FIG. 1, broken away, showing an embodiment of a brace body engaging an object.
Figure 3:
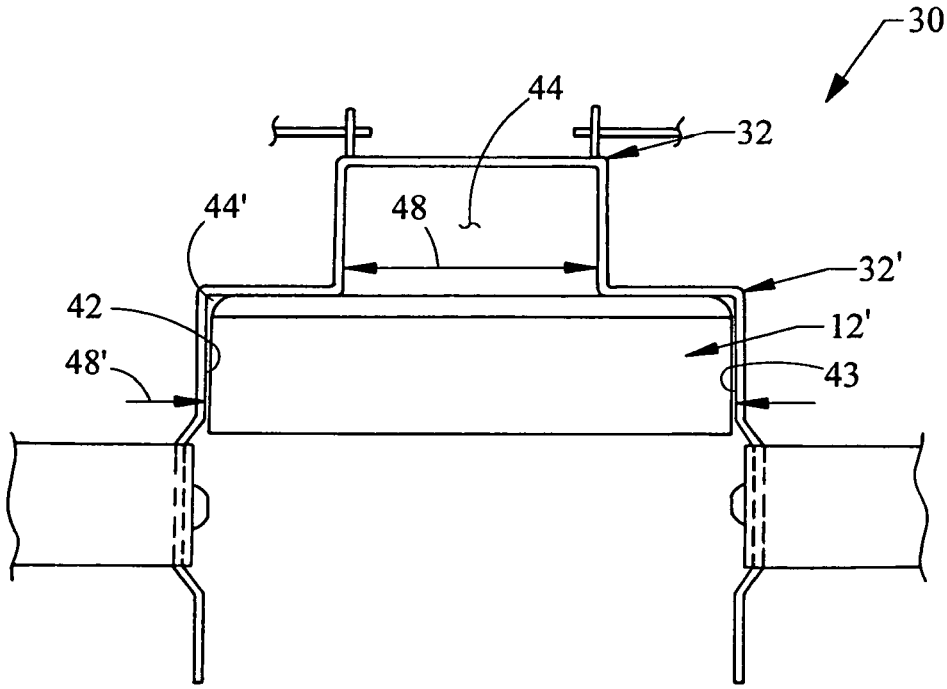
FIG. 3 provides an end-on view of FIG. 1, broken away, showing an alternative embodiment of a brace body engaging an object.

FIGS. 2 and 3 provide an end-on of FIG. 1, showing an embodiment of a brace body 30 with the securing members 60 and optional handle 20 broken away. In FIG. 2, a post 12 is disposed within the first brace body channel 44. FIG. 3, in contrast, shows a post 12' disposed within the second brace body channel 44'. For clarity, reference numerals in FIG. 3 have mostly been omitted, but would have numerals as shown in FIG. 2.

In addition, it should be understood that the post 12 in one preferred embodiment fits snugly within one of the first and second brace body channels 44, 44', respectively. Likewise, the post 12 in a preferred embodiment may fit snugly against the inside surfaces 42, 43 of the first bracket 32 and/or snugly against the inside surfaces 42', 43' of the second bracket 32. Also, the invention contemplates that the fit may be anything from lightly snug to very snug of the post 12, as desired. The lighter snug fit means that the user may lift the device off the post 12 more easily than the very snug fit. There may be times when a very snug fit is desired, and other times when a lightly snug fit is required, and all these fits (and those in between) are within the scope of the invention. The invention is broader than a snug fit, however, and other embodiments are disclosed later in FIGS. 4, 5, and 6 where there optionally is a loose fit if the user so desires. In those embodiments, a user may utilize one or more optional and detachable stabilizers 52, 52' to provide the desired snug fit, which provides a user with more control in determining the degree to which the device 10 mounts snugly upon the post, and provides a user with a great range of posts 12 (measuring less than about 1½ inches and more than about 3½ inches in width) as an alternative embodiment that gives the user a device with one-size-fits-all properties, so to speak.

Figures 4, 5:
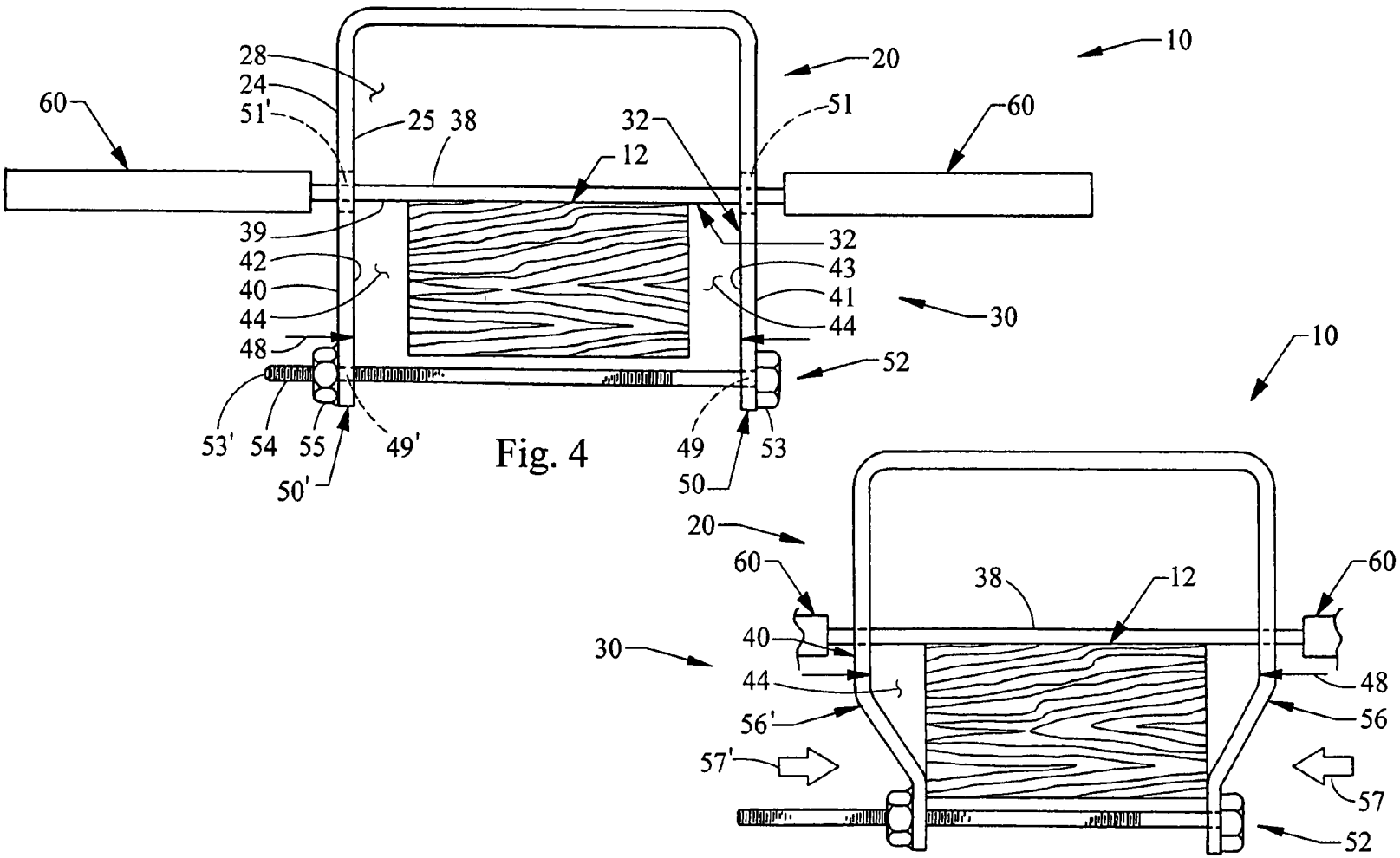
FIG. 4 provides an end-on view of an alternative embodiment of a brace body according to the invention.
FIG. 5 illustrates a view, broken away, of another embodiment of a brace body according to the invention.
Figure 6:
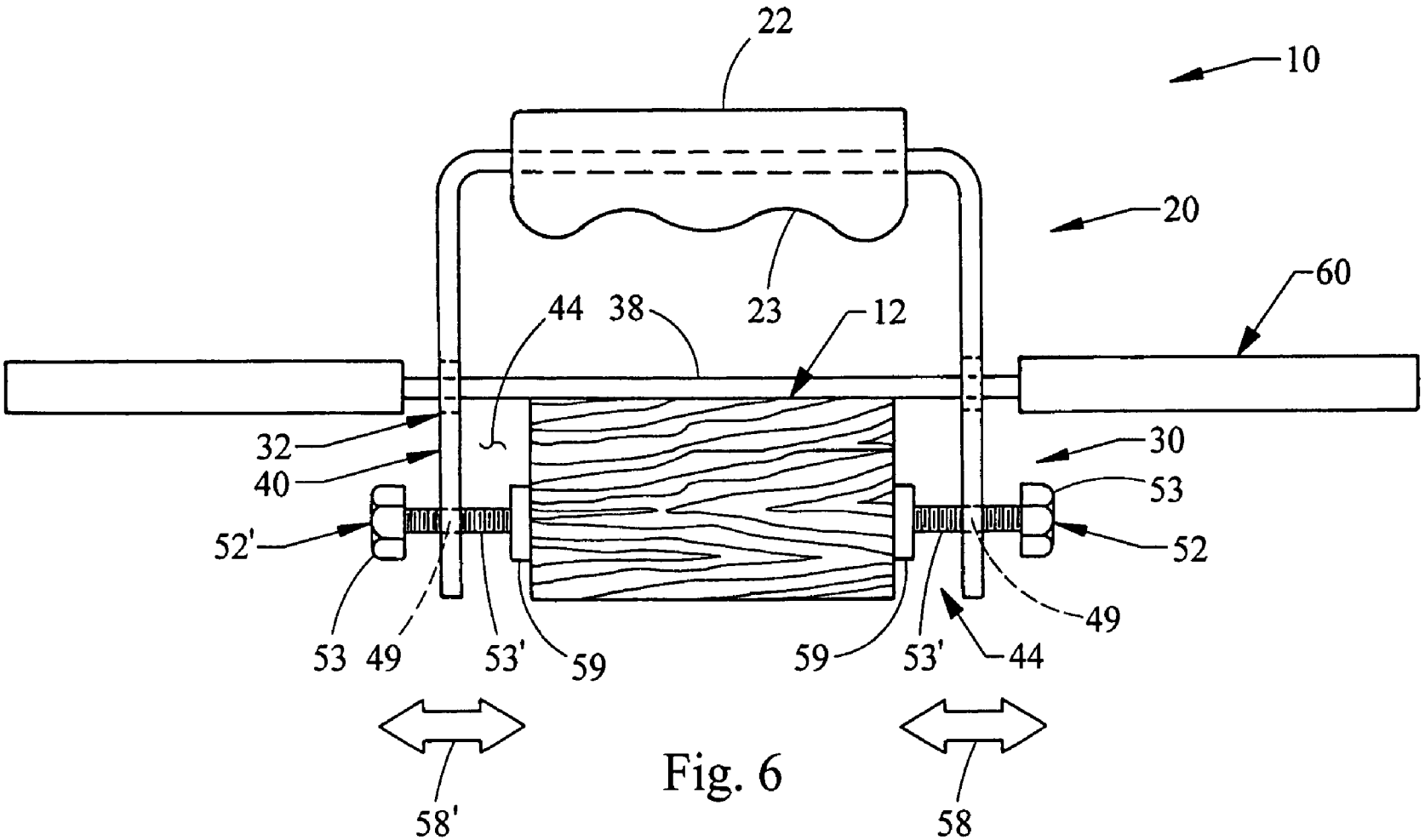
FIG. 6 provides an end-on of still another embodiment of a brace body according to the invention.

FIGS. 4, 5 and 6 provide end-on views of alternative embodiments of a device 10 according to the invention. The device comprises a base body 30, securing members 60, and an optional handle 20. In describing these embodiments, the terminology includes but is not limited to the description used above, equivalents thereof, and features performing similar functions as understood by those skilled in the art.

More particularly, the embodiments illustrated in FIGS. 4, 5, and 6 show that the securing members 60 may be disposed intermediate the handle 20 and a bottom portion of the brace body 30 such as the legs 50, 50', respectively, as but one example. In another case, the securing members 60 may be disposed intermediate the first bracket 32 and a lower second bracket 32' (e.g., FIGS. 1-3). Indeed, the securing members 60 may be aligned with the brace body's support member 38, with the lateral restraints 40, 41 extending below the plane of the securing members 60. Optionally, the attachment joints 51, 51', which hold the securing members 60 to the brace body 30, further join the handle 20, although the device 10 may also use tabs 26, 26' (e.g. FIGS. 1-2) for holding the handle ends 25, as with tab receptors 27, 27' (e.g. FIGS. 1-2).

FIGS. 4, 5, and 6 further illustrate a post 12 disposed within the first brace body channel 44, below the support member 38. The embodiments shown in these figures optionally include one or more stabilizers 52, which may be below the post 12 as in FIG. 4, on the side as in FIG. 6, or both as in FIG. 5. The stabilizer 52 may be any structure configured for providing support to a bottom or side surface of the post, or configured for providing support to the legs 50, 50' or the first and second brackets 32, 32', respectively.

The stabilizer 52 may be any support structure selected from the group consisting of a brace, connector, fastener, nut, bolt, screw, thread, cotter and pin, thread, clip, tie, or any combination thereof. For instance, FIG. 4 shows a connector bolt having a head end 53 and a tail end 53'. While the tail end 53' is configured to pass slideably through apertures 49, 49' in the brace body 30, the head end 53 may be sized to prevent passage through the apertures 49, 49'. The brace body apertures 49, 49' may be in the lateral restraints 40, 41 and/or the legs 50, 50'. Optionally, the aperture 49' may be threaded for securing stabilizer threads 54 disposed about the second end 53'. If the aperture 49' is unthreaded, then the stabilizer 52 may use a nut 55 for securing the threads 54 and, thereby the stabilizer 52 to the brace body 30. The head end 53 may have a recess or slot (not shown) for receiving any tool for turning the stabilizer, such as a regular or Phillips screwdriver or a hexagonal wrench. Also, the user may simply use fingers to turn the stabilizer. When using a nut 55, a wrench or the user's fingers may hold the nut 55.

In FIG. 5, the stabilizer 52 is below the post 12, so that it may provide support normal to a bottom surface of the post. For clarity, reference numerals in FIG. 5 have mostly been omitted, but would have numerals as shown in FIG. 4. FIG. 5 further shows that the first and second brackets 32, 32', respectively, may have a bend 56, 56' at the lateral restraints 41, 40 or the legs 50, 50'. Turning the stabilizer 52 causes the bracket to move inward along the arrows 57, 57' and toward the first brace body channel 44. Therefore, the bracket bends 56, 56' thereby engage and provide lateral support to the side surfaces of the post 12.

FIG. 6, for clarity, has omitted most reference numerals, but would have numerals as shown in FIG. 4. As shown in FIG. 6, the handle 20 in one embodiment has an optional gripping attachment 22. In this embodiment, the gripping attachment 22 provides grooved contours 23 as a gripping surface for fingers. The gripping attachment 22 may have any desired shape, may be machined, cut, milled, extruded, molded, or formed by any suitable means, and may be secured to the holding body 24 of FIG. 1 by adhesives, resins, welding, soldering, brazing, adhesives, or any suitable means such as wrapped around or even integrally pre-formed to the holding body 24 of FIG. 1.

FIG. 6 further shows an embodiment of the invention comprising two stabilizers 52, 52'. Also, the stabilizers may be pre-fitted into the apertures, whereby the head 53 and tail 53' stops 59 have diameters that occlude passage through the apertures 49, 49'. In the alternative, the tail 53' stops 59 may be detachable from the tails 53' and the stabilizer removable through the aperture 49, 49'. As shown by the arrows 58, 58', the stabilizers 52, 52' are independently moveable into and out of a post retaining position. The stops 59, 59' comprise any structure adapted to a restrain the post 12 from the side. Removable stops 59, 59' permit easy replacement of parts sized having different areas surface areas and made of different materials to fit a variety of posts.

Figure 7:
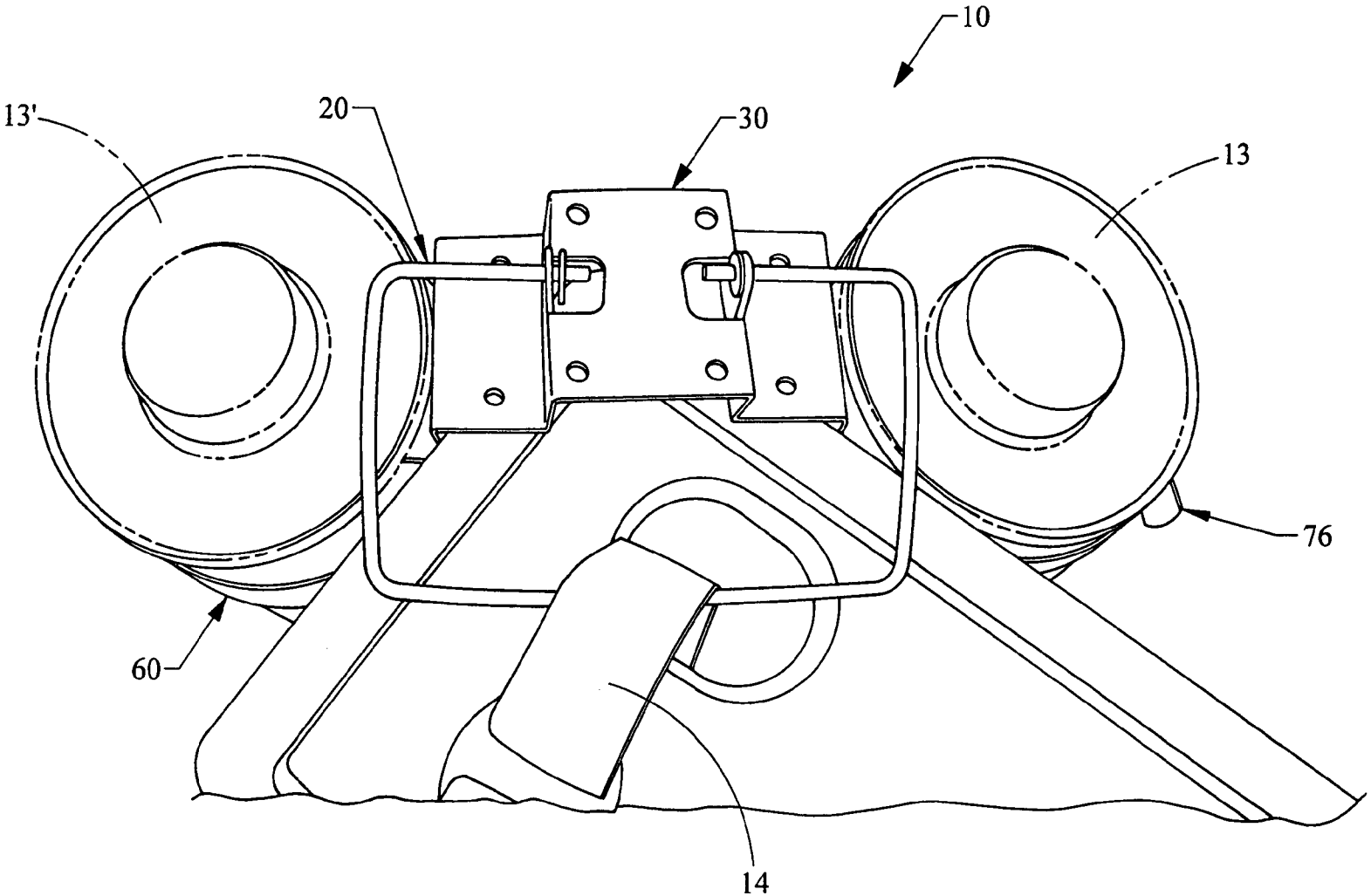
FIG. 7 illustrates a top perspective view of a device detachably securing cans according to one embodiment of the invention.

FIG. 7 illustrates a top perspective view of a device 10 detachably securing cans 13, 13' according to an embodiment of the invention. This embodiment shows that, in addition to using the device 10 as disclosed in FIGS. 2 and 3, the device could be used in the manner disclosed in FIG. 7, whereby the device 10 works even when the post fits within only a portion but less than all of the second brace body channel 44'. Similarly, the device 10 works when the first brace body channel 44 only partially engages the post (not shown). Furthermore, a detachable shoulder strap 14, broken away, may be used for carrying the device by the handle and, thereby, freeing the user's hands. The strap 14 may be removed or strapped to an object during use. Moreover, the handle 20 may hung from any number of objects, such as a hook, nail, bolt, clamp, or other fastening device as understood by those of ordinary skill in the art and consistent with the invention.

Figure 8:
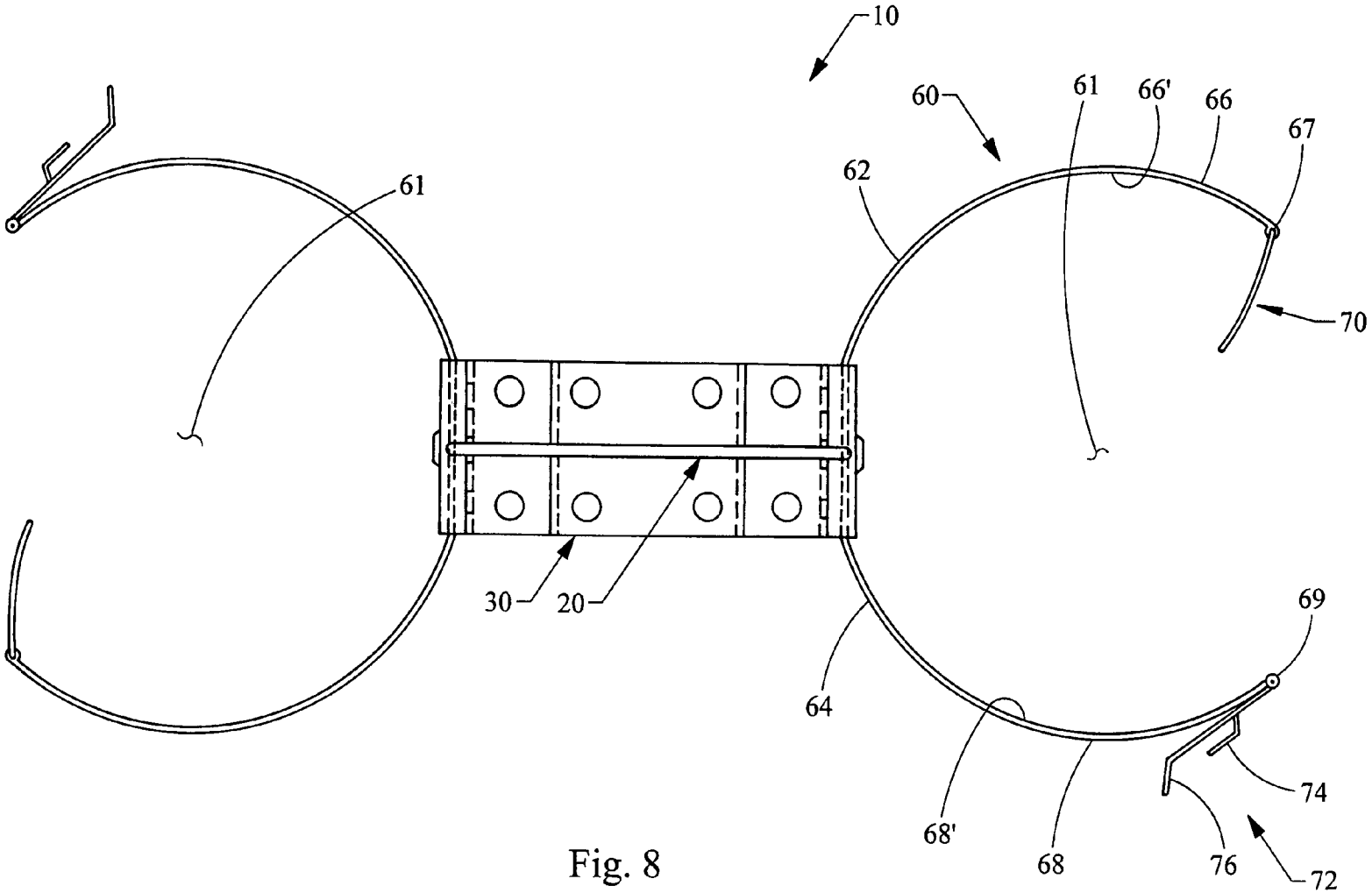
FIG. 8 provides a plan view of a device showing securing members according to one embodiment of the invention.
Figure 8A:
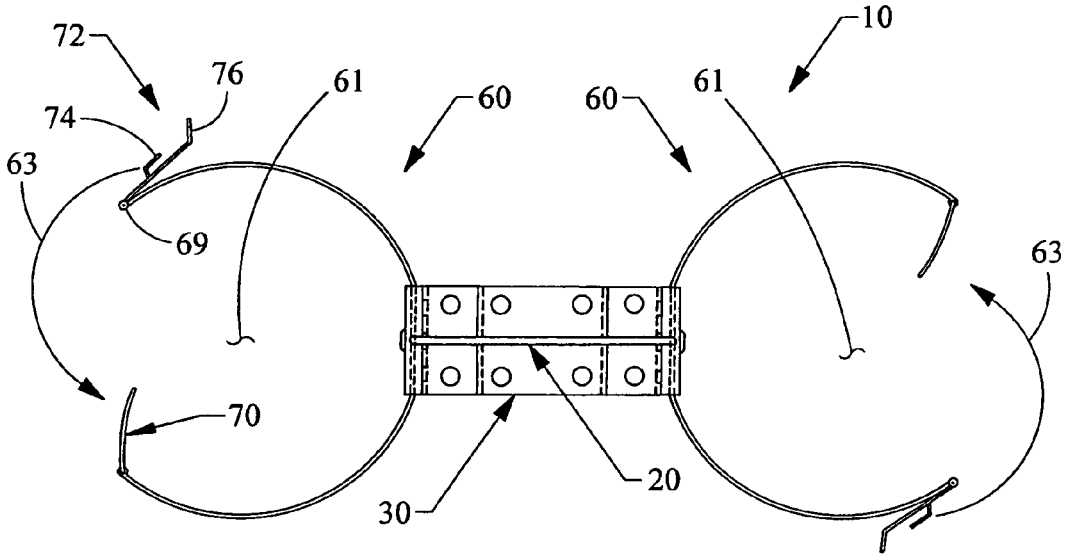
FIG. 8A provides a plan view of securing members moving into a first engagement position.
Figure 8B:
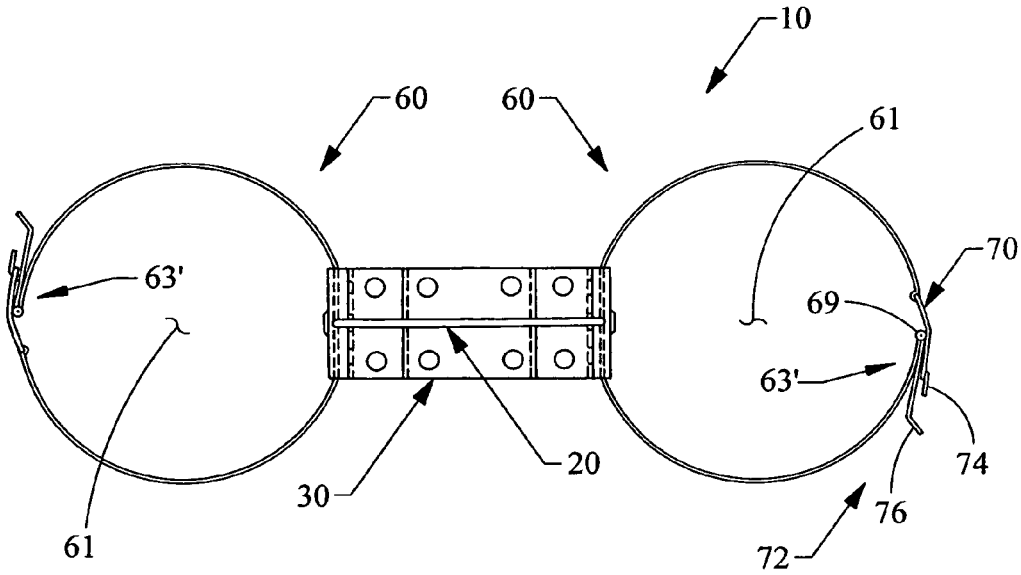
FIG. 8B provides a plan view of securing members in a second compressed engagement position.

Turning now to FIGS. 8, 8A, and 8B, securing members 60 are shown. More particularly, FIG. 8 provides a plan view of a device 10 showing securing members 60 according to one embodiment of the invention. FIGS. 8A and 8B provide plan views of securing members during engagement. In FIG. 8A, the securing members are moving 61 into a first engagement position, whereby the clasp 74 for the latch member 72 inserts into the receiving compartment (FIG. 1) of latch member 70. FIG. 8B provides a plan perspective view of securing members in a closed state having a second compressed engagement position 61'. In this closed state, the latch member 72 has swung away from the latch member 70 pulling the arms 62 and 64 closer to each other. The latch members 72, 70 overlap the approximate distance from about 69 to 74 and thereby formed a circumferential compression fit with high pull-apart strength. Yet, the offset tab 76 on the latch member 72 allows the user to quickly and easily unhook the latching members.

Figure 9:
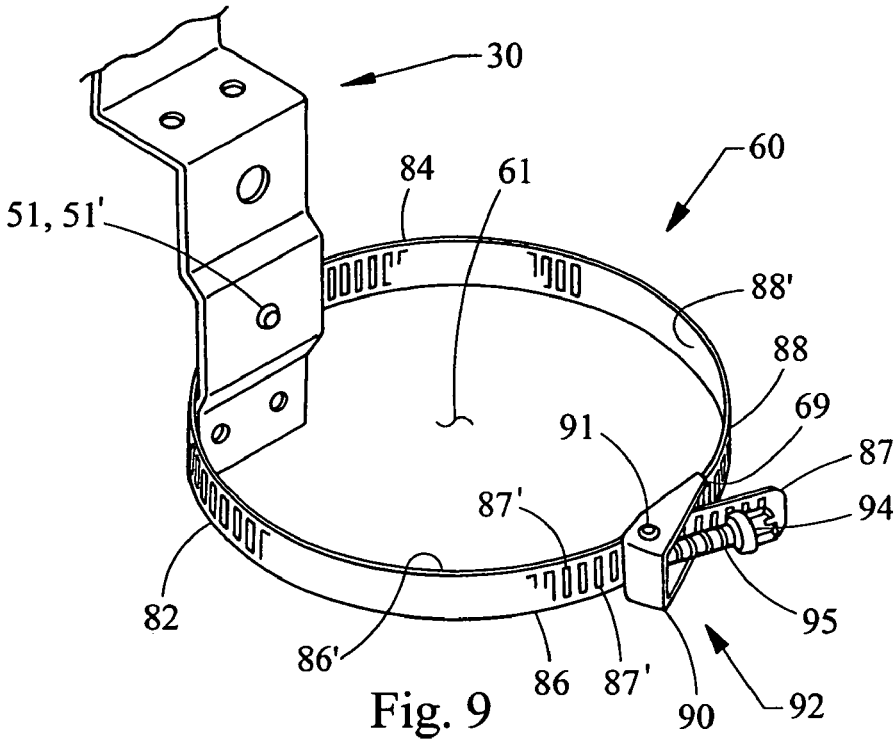
FIG. 9 provides a perspective view, broken away, showing securing members according to an alternative embodiment of the invention.

FIG. 9 provides a perspective view, broken away, showing securing members according to an alternative embodiment of the invention. In this embodiment, the arms 82, 84 terminate at latch end portions 86, 88, respectively. The latch end portion 86 of the arm 82 has a latch member 87 that comprises thread receiving slots 87'. The latch end portion 88 of the arm 84 terminates at a latch member 90 that secures to the arm 84 by a link member 69 and has a compartment 92 for receiving the latch 87 of the arm 82. The latch member 90 comprises a screw 94 rotatably secured to the latch member by any suitable means, such as a link member 91. The screw 94 has a thread 95 that engages the thread receiving slots 87' of the latch member 87.

Before the latch end portion 87 of arm 82 is inserted into compartment 92 of arm 84, the arms are configured with an open state for receiving a can with substantially zero insertion force, as previously described. According to a closed state of this embodiment of the invention, the latch member 87, 90 of each arm 86, 84, respectively, joins with the latch member of the opposing arm in a first engagement position about the can. After engaging the thread 95 to the thread receiving slots 87', the screw 94 is turned such that the latch member 77 moves further through the compartment 92, which pulls the latch member the arms 84, 86 into a closed position and thereby tightens the hold on the can. According to this configuration, the latch member 87, 90 of each arm 86, 84, respectively overlaps and moves the arms into a second compressed engagement position about the can. This second position results in a closed state for supplying a compression fit with high pull-apart strength. Because the screw 94 may be turned in reverse (or its threads 95 simply snapped out of the thread receiving slots 87') for unlatching the latch members and reopening the securing arms in order to quickly and easily release the cans.

Figure 10:
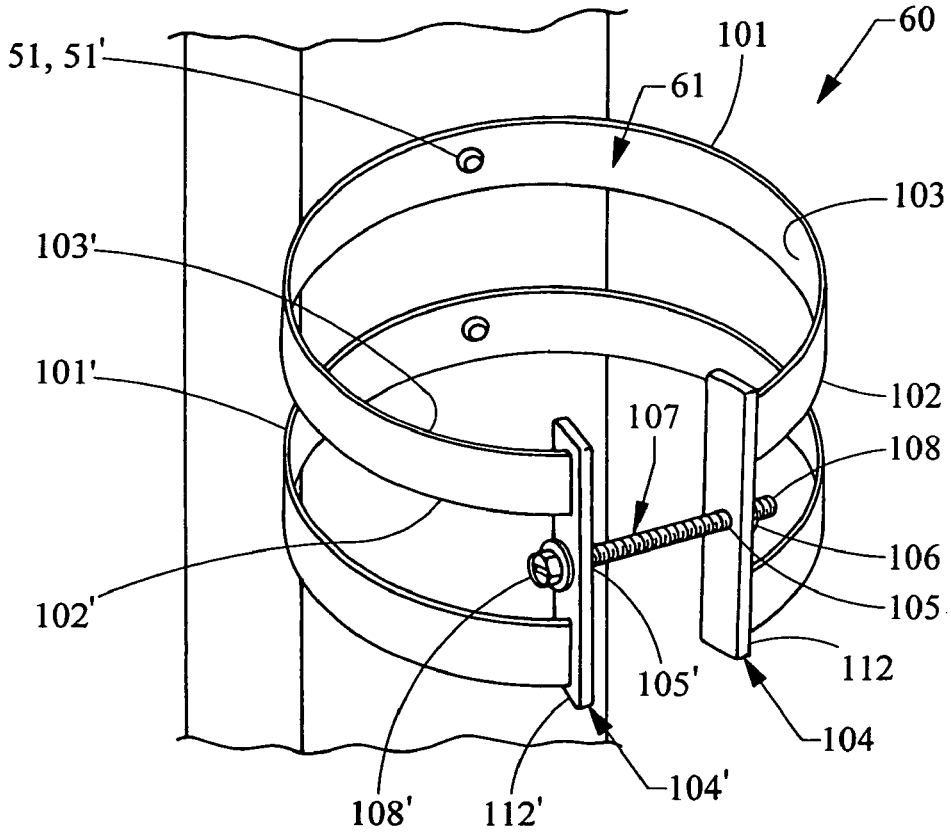
FIG. 10 provides a perspective view, broken away, showing securing members according to another embodiment of the invention.

FIG. 10 provides a perspective view, broken away, showing securing members according to another embodiment of the invention. In this embodiment, there may be a pair of two parallel arms 101, 101' for each can (the other set is not shown). This embodiment also illustrates another embodiment of latch members that could be used with the other embodiments. Each arm 101, 101' has an end portion 102, 102', respectively, that secures to a latch member 104, 104' that comprises a connector plate 112, 112' having a screw receiving aperture 105, 105' sized to receive a screw 107, and a screw 107. Either aperture may have threads, or if without threads then an optional nut 106 is shown for tightening the connector plates 112, 112'. A screw 107 has a tail end portion 108 that inserts through the apertures 105, 105' and a head end portion 108' sized to occlude passage through the 105, 105'.

Before the screw 107 is inserted into the apertures 105, 105', the arms are configured with an open state for receiving a can with substantially zero insertion force, as previously described. According to a closed state of this embodiment of the invention, the latch member 104, 104' of each arm 101, 101', respectively, joins with the latch member of the opposing arm in a first engagement position about the can via the connector plates and screw arrangement. After screw is inserted into the apertures 105, 105', the screw 107 is turned such that the latch members 104, 104' are pulled into a closed position and thereby tightens the hold on the can. According to this configuration, continued turns on the screw 107 moves the arms progressively closer and into a second compressed engagement position about the can. As a result, the screw 107 overlaps both connector plates 112, 112' during engagement. Optionally, when the latch members 104, 104' are beveled (or otherwise angled relative to the movement) they also move into overlapping angular engagement. This second compressed engagement position results in a closed state for supplying a compression fit with high pull-apart strength. The screw 107 may be turned in reverse for unlatching the latch members and reopening the securing arms in order to quickly and easily release the cans.

Figure 11:
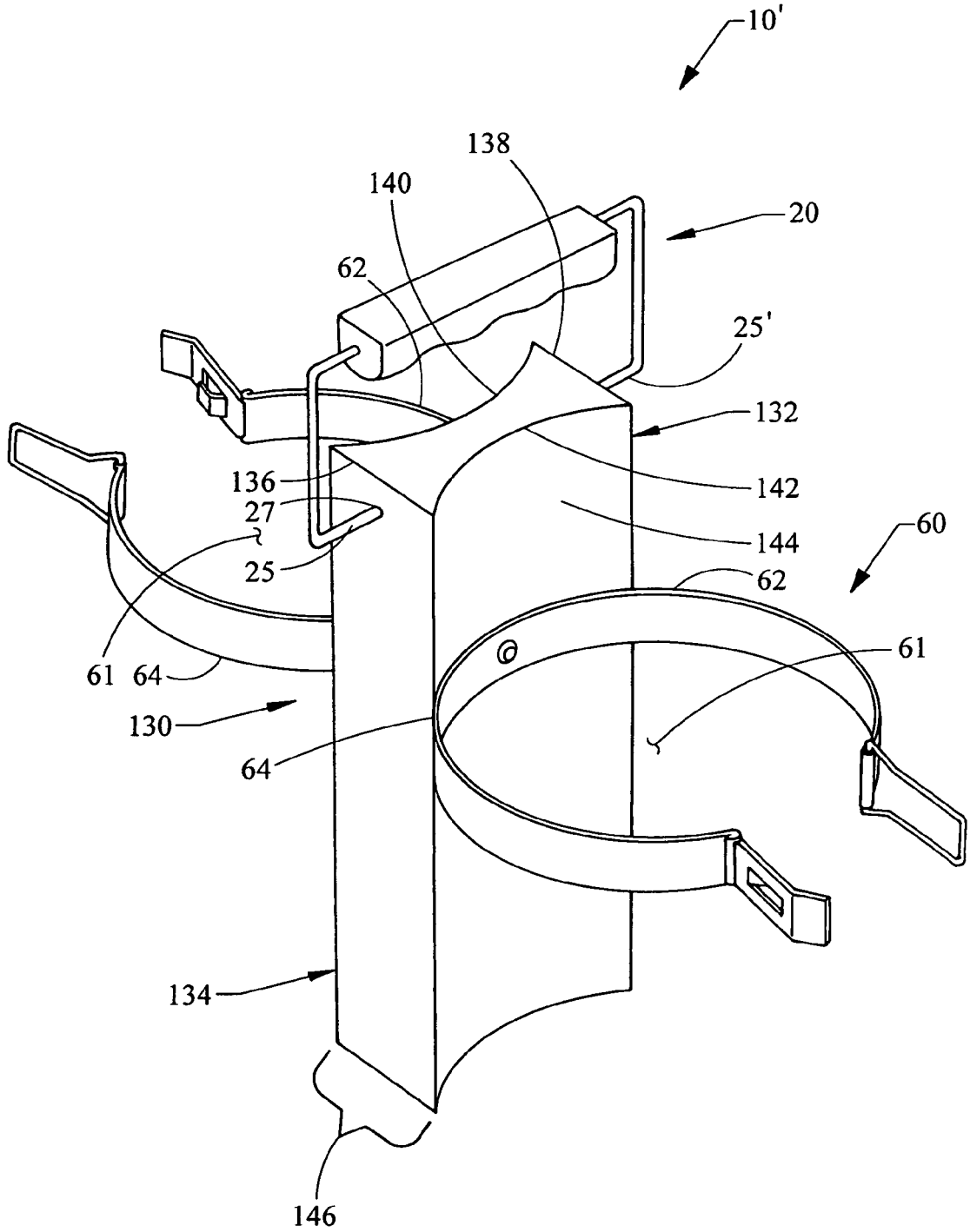
FIG. 11 provides a perspective view of a device for detachably securing cans and other objects according to an embodiment of the invention having a support body.

FIG. 11 shows an alternative embodiment of the device 10' comprising a handle portion 20 as previously described, at least two securing members 60 as previously described, and a support body 130 for rotatably securing the handle and for attaching the securing members 60. The support body 130 may be made of any suitable material (natural, synthetic, plastic, metal, or combination thereof). In one embodiment, the support body 130 comprises light weight metal alloy, such as aluminum or titanium alloys, or a plastic, such as PVC.

The support body 130 has a handle portion 132 and a base portion 134, and in one embodiment has four sides 136, 138, 140, and 142. In another embodiment, the support body 130 may be cylindrical, hourglass, and the like to give a substantially upright or vertical configuration. In the embodiment with four sides 136, 138, 140, and 142, these sides may give the support body 130 a substantially upright or vertical configuration. Additionally, two opposing sides 140, 142 optionally have an approximately concave surface 144. The handle portion 132 has receptors 27 on opposing sides (or one receptor such as a channel extending there through), such as 136 and 138, for rotatably receiving handle end portions 25, 25'. The base portion 134 comprises a stand 146, and increasing the concave surface 144 of the sides 140, 142 increases the stability of the stand 146 and allow the device 10' to stand upright on a post or other surface such as the ground, floor, and the like. Intermediate the handle and base portions 132, 134, respectively, the support body 130 has joints 51, 51' for attaching the securing member 60 as previously described. Optionally, the attachment joints 51, 51' are disposed at the base portion 134 such that the stand 146 comprises the securing members 60.

Figure 12:
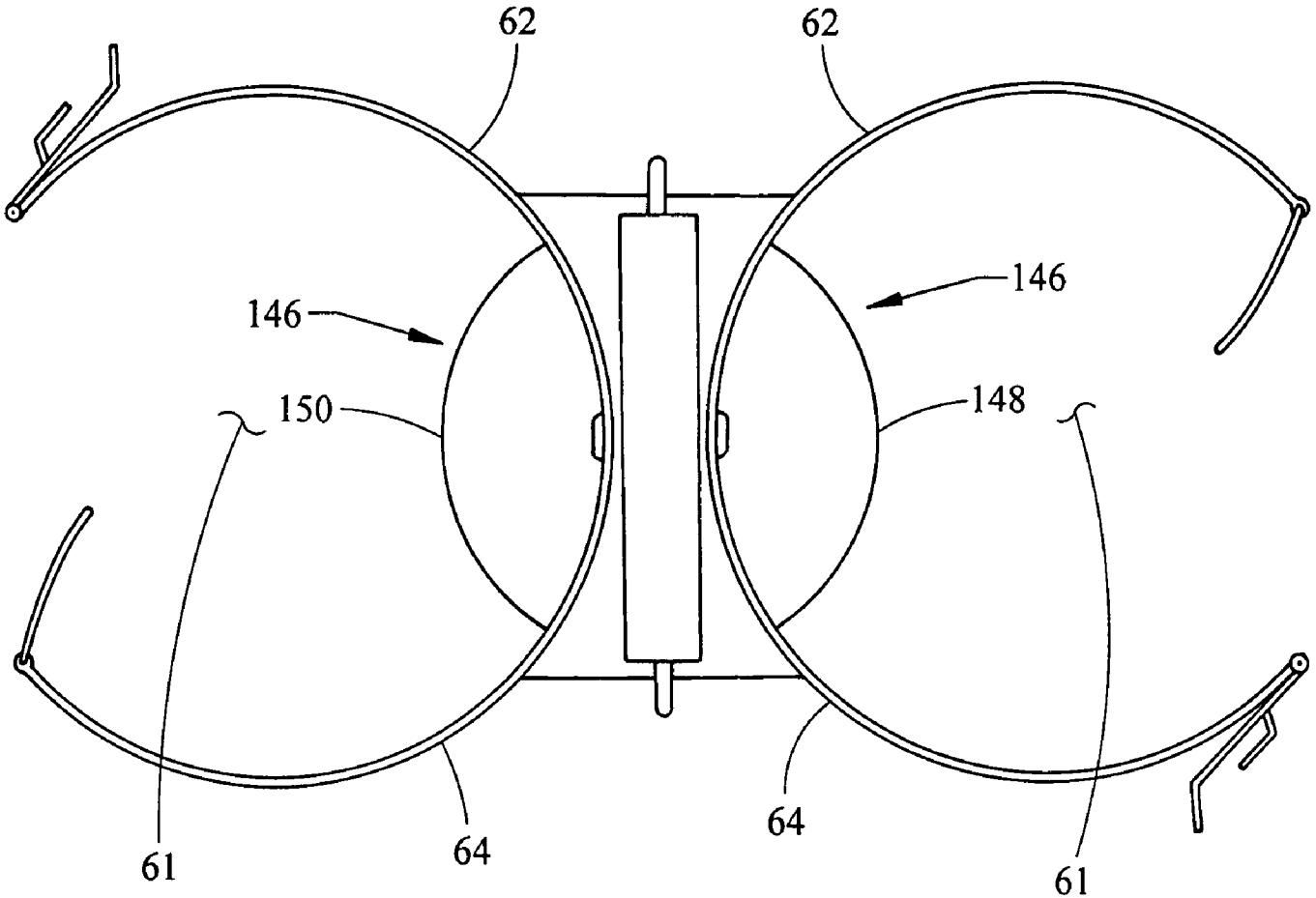
FIG. 12 provides a plan view of the embodiment shown in FIG. 11 with a base portion according to another embodiment of the invention.

FIG. 12 provides a plan view of FIG. 11 with a base portion according to another embodiment of the invention. This base portion comprises a stand 146 having legs 148, 150 extending laterally from each concave side for increasing the stability of the stand 146. Optionally, the legs could also extend laterally from any two (or more) of the four sides. Optionally, the legs 148, 150 are the securing member arms in an embodiment where the securing member is joined to an attachment joint 51, 51' disposed at the base portion 134.

It should be understood that the securing members 60 as previously described are used with the device 10'. Therefore, the previous description is incorporated by reference. Additional types of securing members may be used with the embodiment shown in FIG. 12, as explained next.

Figure 13:
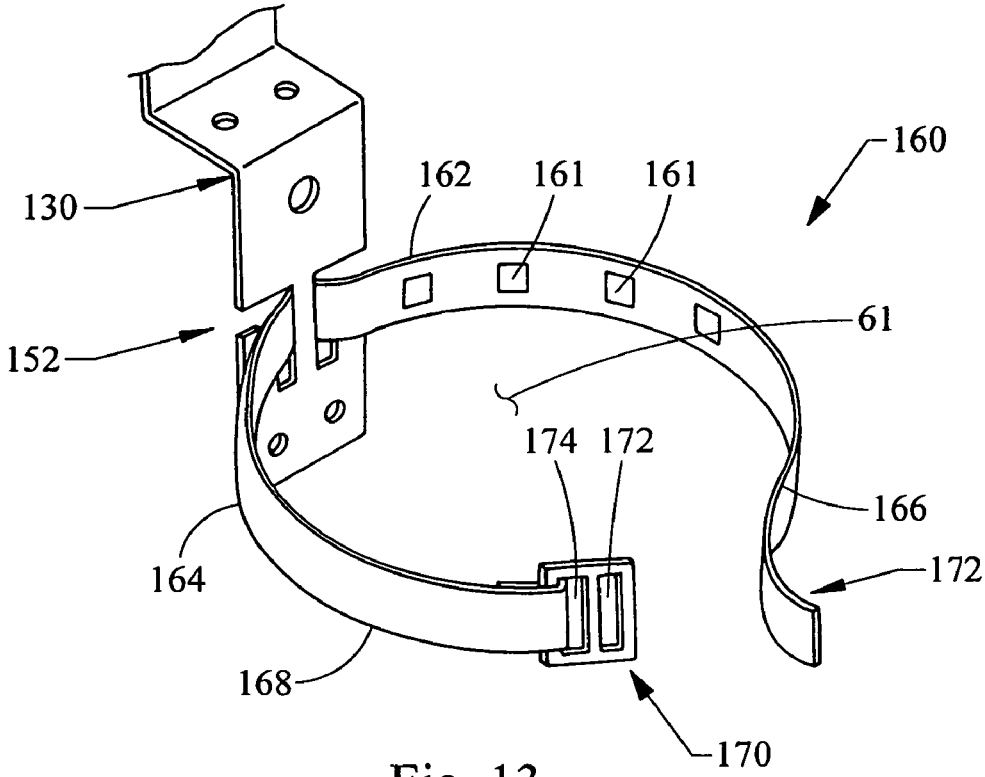
FIGS. 13 and 14 illustrate a perspective view, broken away, of alternative embodiments of securing members.
Figure 14:
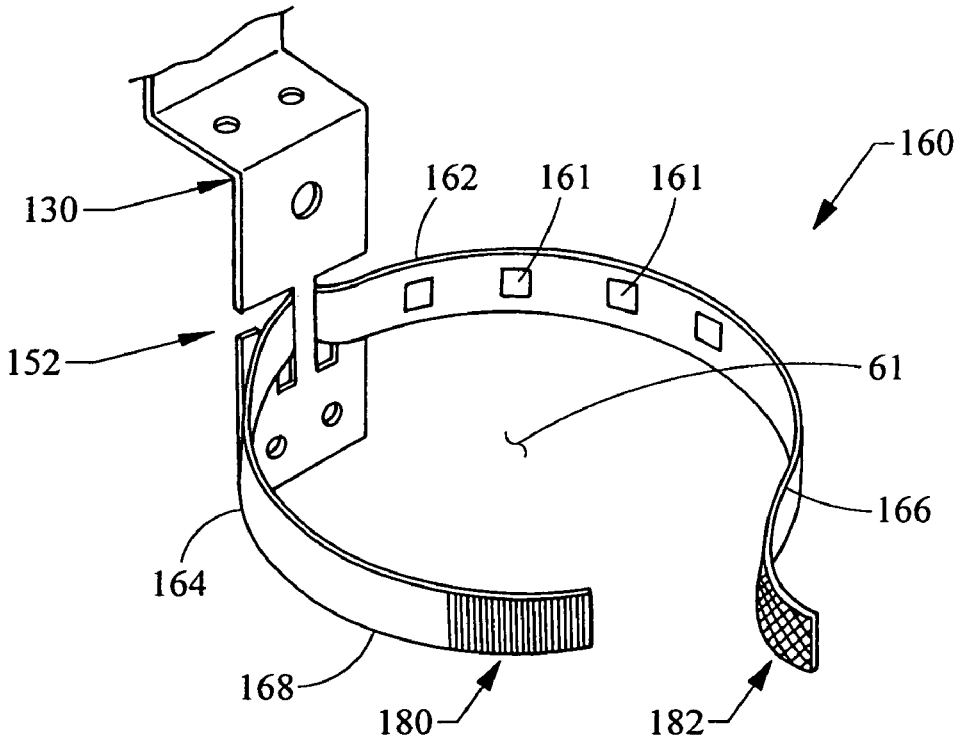

FIGS. 13 and 14 illustrate a perspective view, broken away, of alternative embodiments of securing members 160 that may be used with a device having a base portion according to FIG. 12 for supporting the weight of a can. The securing members 160 may attach to the support body 130 via joints 51, 51' as previously described. Furthermore, they may removably attach through a slotted tab 152 formed in the support body 130.

The securing members 160 have two moveable arms 162, 164 extending laterally from the support body 130 and adapted for detachably engaging a can. Furthermore, the arms have engaging inner strips 161, such as rubber or adhesives, for increasing the hold on a can. Moreover, the arms 162, 164 further have a latch end portion 166, 168, respectively, for securing latch members 170, 172 (FIG. 13), 180, 182 (FIG. 14), respectively.

In FIG. 13, a latch member 170 comprises a buckle with slots 172, 174 for detachably receiving a latch member 172 of the opposing arm 162. In FIG. 14, latch members 180, 182 comprise a hook and loop attachment, such as but not limited to Velcro. According to the configurations shown in FIGS. 13 and 14, the latch members are joined to bring each arm 162, 168 into a first engagement position about the can. According to this configuration, the latch members overlap and are pulled tightly to increase their overlap and, thereby, to move the arms into a second compressed engagement position about the can. With the support body 130 abutting the can on a side and the legs 148, 150 helping to support the can at the bottom, this second position results in a closed state for supplying a compression fit with high pull-apart strength. Unlatching the latch members quickly and easily releases the cans.

In one embodiment, the foregoing devices may comprise a carrying tool for detachably securing CPVC and PVC glue and primer quart cans.

Methods

Figure 15:
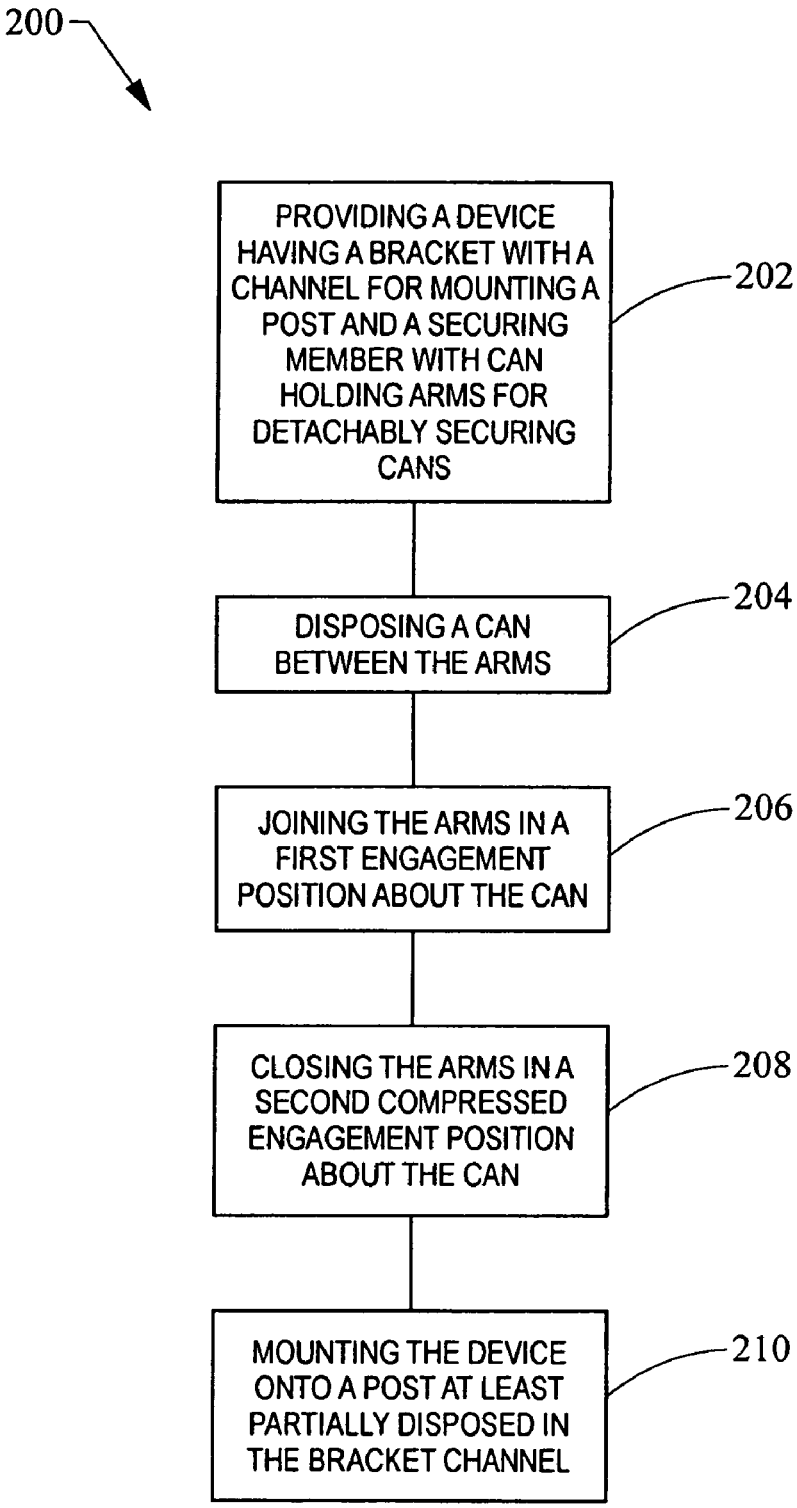
FIG. 15 is a block diagram illustrating a method of the invention.

Methods of detachable securing cans are also provided. FIG. 15 shows one embodiment of the method 200 according to the invention. A device for detachably securing cans is provided (step 202), the device having a body comprising a bracket having a channel configured to mount a post, and having two securing members extending approximately 180 degrees apart from a body, and each securing member having a pair of arms having end portions with latch members and configured to be arranged in an open state for receiving the can with substantially zero insertion force and having latch members configured to overlap and provide a circumferentially closed state about the can with a compression fit having a high pull-apart strength. A can is disposed between the arms (step 204). The latch member of each arm is joined (step 206) with the latch member of the opposing clamp arm in a first engagement position about the can. The first engagement position is disposed about substantially most of the can circumference. The latch members are closed (step 208) such that the latch members partially overlap and move the arms into a second compressed engagement position about the can for supplying a compression fit with high pull-apart strength. The device is mounted (step 210) onto a post such as disposing a portion of the post within the bracket channel. In another step, the latch members are unlatched for reopening the securing arms in order to release the can.

It is intended that the foregoing detailed description of the can securing devices and methods be regarded as illustrative rather than limiting, and that it be understood that it is the following claims, including all equivalents, that are intended to define the spirit and scope of this invention. Terms are to be given their reasonable plain and ordinary meaning. Also, the embodiment of any figure and features thereof may be combined with the embodiments depicted in other figures. Other features known in the art and not inconsistent with the structure and function of the present invention may be added to the embodiments.

The foregoing disclosure includes the best mode devised by the inventor for practicing the invention. While particular elements, embodiments and applications of the present invention have been shown and described, it will be understood, of course, that the invention is not limited thereto since modifications may be made by those skilled in the art, particularly in light of the foregoing teachings. It is apparent, however, that several variations in accordance with the present invention may be conceivable by one skilled in the art. Therefore, it is contemplated that the appended claims should be construed to include such modifications and to cover such modifications and incorporate those features that come within the spirit and scope of the invention.

What is claimed is:

1. A device for detachably securing two or more cylindrical objects at a worksite to either a post or a ladder, the device comprising: a brace body having a first bracket, the first bracket including a first horizontal support member and two first downward lateral restraints protruding down from outermost ends of the first horizontal support member and spaced apart to form a first brace body channel below the first horizontal support member and between the first downward lateral restraints to accommodate a post to support the device; the brace body further having a second bracket, the second bracket including two second horizontal support members perpendicularly attached to a bottom end of each of the first downward lateral restraints and further including two second downward lateral restraints protruding down from an outermost end of each second horizontal support members to form a second brace body channel below the second horizontal support members and between the second downward lateral restraints to accommodate a ladder rung to support the device, wherein the first and second brackets are arranged in a stair-stepped configuration from the first horizontal support member to the first downward lateral restraints to the second horizontal support members to the second downward lateral restraints; two securing members attached to each of the second downward lateral restraints and extending laterally from said brace body, the securing members each having a pair of holding arms to secure said cylindrical objects therein with substantially zero insertion force; and wherein said each second downward lateral restraint has a recess to accommodate the attachment of said securing members, so that the insertion of said ladder rung is not interfered with by said securing members when said device is secured to said ladder rung.

2. The device of claim 1 further comprising a handle secured to the brace body.

3. The device of claim 2 wherein the handle is rotatably secured to the brace body.

4. The device of claim 1 further comprising an attachment joint joining the brace body and securing members, the attachment joint being selected from the group consisting of a nut, bolt, screw, brace, thread, cotter and pin, clip, crimp, swage, thread, full or partial bearing, rivet, pin, fastener, interlocking members, glue, adhesive, resin, welding, soldering, brazing, heat bonding, chemical bonding material, and combinations thereof.

5. The device of claim 1 wherein the brace further comprises a pair of legs.

6. The device of claim 1 wherein the securing members are spaced apart approximately 180 degrees of the other.

7. The device of claim 1 wherein the securing members further comprise a substantially zero insertion force can receiving socket disposed between the pair of can holding arms.

8. The device of claim 7 wherein the can holding arms further comprise latch end portions configured to receive said can in an open state with substantially zero insertion force and having can contacting portions configured to detachably secure said can in a closed state.

9. The device of claim 8 wherein the securing member comprises latch members configured to detachably join the latch end portions in a partially overlapping arrangement and provide a circumferentially closed engagement about said can with a compression fit having a high pull-apart strength.

10. The device of claim 1 wherein the securing member comprises a band clamp.

11. A device for detachably securing two or more cylindrical objects at a worksite to either a post or a ladder, the device comprising: a brace body having a first bracket, the first bracket including a first horizontal support member and two first downward lateral restraints protruding down from outermost ends of the first horizontal support member and spaced apart to form a first brace body channel below the first horizontal support member and between the first downward lateral restraints to accommodate a post to support the device; the brace body further having a second bracket, the second bracket including two second horizontal support members perpendicularly attached to a bottom end of each of the first downward lateral restraints and further including two second downward lateral restraints protruding down from an outermost end of each second horizontal support members to form a second brace body channel below the second horizontal support members and between the second downward lateral restraints to accommodate a ladder rung to support the device, wherein the first and second brackets are arranged in a stair-stepped configuration from the first horizontal support member to the first downward lateral restraints to the second horizontal support members to the second downward lateral restraints; two securing members attached to each of the second downward lateral restraints at an attachment joint and extending laterally from said brace body, the securing members each having a pair of holding arms to secure said cylindrical objects therein with substantially zero insertion force, each holding arm having a latch member to detachably join in a partially overlapping arrangement and provide a circumferentially closed arrangement about said object with a compression fit having a high pull apart strength; and wherein said each second downward lateral restraint has a recess to accommodate the attachment of said securing members, so that the insertion of said ladder rung is not interfered with by said securing members when said device is secured to said ladder rung.

12. The device of claim 11 further comprising a handle secured to the brace body.

13. The device of claim 12 wherein the handle is rotatably secured to the brace body.

14. The device of claim 11 wherein the attachment joint is selected from the group consisting of a nut, bolt, screw, brace, thread, cotter and pin, clip, crimp, swage, thread, full or partial bearing, rivet, pin, fastener, interlocking members, glue, adhesive, resin, welding, soldering, brazing, heat bonding, chemical bonding material, and combinations thereof.

15. The device of claim 11 wherein the brace further comprises a pair of legs.

16. The device of claim 11 wherein the securing members are spaced apart approximately 180 degrees of the other.

17. The device of claim 11 wherein the securing member comprises a band clamp.

* * * * *